United States Patent [19]

Suhr et al.

[11] Patent Number: 4,718,725

[45] Date of Patent: Jan. 12, 1988

[54] SUPPORT-AND ADJUSTING DEVICE FOR SEAT AND BACKREST ON A WORK CHAIR

[75] Inventors: Heinz-Peter Suhr, Grossbottwar; Bernd Weinberger, Steinheim, both of Fed. Rep. of Germany

[73] Assignee: Firma August Froscher G.m.b.H. & Co. K.G., Steinheim, Fed. Rep. of Germany

[21] Appl. No.: 890,768

[22] Filed: Jul. 25, 1986

[30] Foreign Application Priority Data

Aug. 2, 1985 [DE] Fed. Rep. of Germany ..... 3527785

[51] Int. Cl.[4] ..... A47C 1/024

[52] U.S. Cl. ..... 297/300; 297/301; 297/326; 297/328

[58] Field of Search ..... 297/300, 301, 302, 304, 297/325–328, 316, 320, 355

[56] References Cited

U.S. PATENT DOCUMENTS

| | | | |
|---|---|---|---|
| 2,650,646 | 9/1953 | Herold et al. | 297/301 |
| 2,746,520 | 5/1956 | Ducrot | 297/325 X |
| 2,859,799 | 11/1958 | Moore | 297/301 |
| 4,143,910 | 3/1979 | Geffers et al. | 297/320 X |
| 4,596,421 | 6/1986 | Schmitz | 297/316 |

FOREIGN PATENT DOCUMENTS

| | | | |
|---|---|---|---|
| 2915368 | 10/1980 | Fed. Rep. of Germany | 297/327 |
| 3316533 | 11/1984 | Fed. Rep. of Germany | 297/316 |

*Primary Examiner*—Kenneth J. Dorner
*Assistant Examiner*—Peter R. Brown
*Attorney, Agent, or Firm*—Robert E. Burns; Emmanuel J. Lobato

[57] ABSTRACT

Support and adjusting mechanism for the seat and backrest of a work chair having a pedestal with feet and a vertical support column comprises a support part fixed on the upper end of the support column and having laterally spaced, parallel upwardly extending support flanges. A seat support has laterally spaced, parallel downwardly extending flanges which partially overlap and are pivotally connected with the flanges of the support part. A backrest support has laterally spaced, parallel, forwardly extending flanges partially overlapping and pivotally connected with the flanges of the support part and also the flanges of the seat support. A coupling lever has spaced, parallel flanges which partially overlap and are pivotally with the flanges of the support part, the seat support and the backrest support. An air spring acts between a lower region of the support part and a lower region of the backrest support.

22 Claims, 6 Drawing Figures

SUPPORT-AND ADJUSTING DEVICE FOR SEAT AND BACKREST ON A WORK CHAIR

DESCRIPTION

Figure 1:
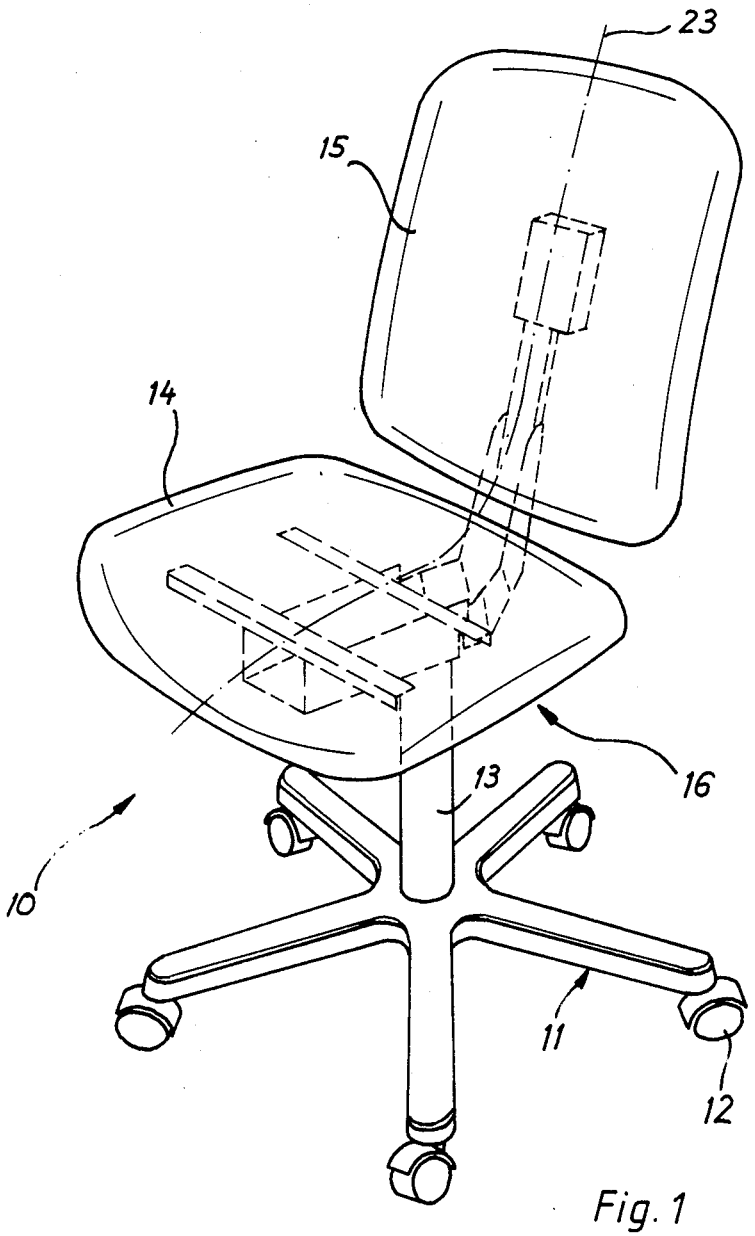

The invention relates to a support and adjusting device for seat and backrest on a work chair with a support part connected with the feet and seat support and backrest support at least partially articulated secured thereon, whereby support part, seat support and backrest support have symmetrically on both sides of the longitudinal central plane of the work chair, vertically extending, at least partially overlapping, support and connecting flanges provided with pivot openings, which are connected with one another, if necessary through coupling members, by means of pivot axis bars.

There are many support and adjustment devices for the seat and backrest of a work chair which have the duty of transmitting the forces from the seat and/or backrest to a pedestal and thereby afford multiple adjustment possibilities and variation possibilities of the inclination of the individual elements alone or in coupled form. Thereby the most diversed kinematic designs have been developed which must satisfy such adjustment requirements or movement requirements of a single movement and/or a coupled movement of the seat and backrest. The inclination movements, adjustment movements and coupled variation movements which at times are occasioned through the user's leaning back require linkage corresponding to such requirements for which there are many kinematic designs. According to the requirements for which the chair is developed, a specific suitable kinematic design has heretofore been developed. Accordingly lever lengths, hinged axes, sliding joints, pivots, supports etc were determined. It thus resulted that a producer who had to make different chair models required a multiplicity of individual parts which were practically not interchangable with one another except perhaps springs, bars, stretching screws and the like. The parts accommodating the hinge axes such as support part, seat support and backrest support were formed individually.

There hence existed basically a need to rationalize the production and stock-keeping. The invention serves this basis need. Moreover, it makes possible tha later changing over of chairs so that, on the one hand, perhaps produced for stock, yet shortly afterwards, other required chairs can quickly be changed over by the producer, by the middleman and on the other hand gives the customer who under circumstances purchases a large number of like chairs, the possibility in individual circumstances, of changing over existing chairs for another adjustment capability or another kind of movement when these prove necessary, for example, from special work conditions or physical characteristics of a user.

Accordingly, the invention is directed to the problem of so forming support and adjustment devices of the seat and backrest of a work chair with the above-mentioned characteristics that on the one hand, the essential components of chairs with different kinematics can be produced alike or similar but however can be assembled with, in part, different connecting means.

It is thereby provided in accordance with the invention that for the selective assembly of adjusting devices for seat and/or backrest working with different linkage, multiangle kinematics pivot axes, respectively pivot openings, are provided at like positions and two selectively insertable coupling levers having at least two pivot openings lying in the same positions are provided of which the respective one is linked on the support part and the backrest support.

The invention thus proceeds in a multi-member manner. It contains the main parts for several kinematic systems. For this, the kinematic design is optimized and pivot points are selected which are favorable for the different adjustment requirements or yet at least lie tolerably and whereby the different requirements are satisfied through selection of specific pivot points and through insertion of intermediate parts. As such movement device requires coupling members besides rigid parts and main parts, the invention provides the coupling in an advantageous way. This however, is provided in different forms so that through the substitution or selcetive use of slightly different coupling levers and corresponding articulation, the different kinematic requirements can be satisfied. Thereby must the coupling levers naturally conform to the different pivot points and lever lengths of the basic kinematic design. Through this ingenious joiing together of design and construction measures, the number of mechanical parts to be manufactured for many chair models can be greatly reduced so that the individual parts can be made in large numbers and thereby rationally produce. Even for the different parts, the pivot openings are in the same position and can be die-punched or otherwise produced with the same work tools, as they are positioned on the same coordinates. This teaching now permits the development a plurality of so-called chair mechanims so that relative expensive chair mechanism can be economically produced, mounted or changed over. Thus, also the requirements for a plurality of desired chair adjustments can be satisfied with only a few easily produced and easily mounted parts while for more expensive movements and adjustment devices, only a few likewise easily produced parts need to be added. There is a plurality of adjustment possibilities which according to such an optimized kinematic device permit the most diverse pivotal multi-angle adjustment and coupling.

Essential part for enabling of the substitution and the creation of different adjustment and movement possibilities is the coupling lever. In a first advantageous embodiment for chair mechanisms differening even from one another, it is provided that the coupling lever is formed as an elongate lever with three pivot openings. It then lies as a rule somewhat flat under the seat and is pivoted approximately in the middle on the axis, to the seat and backrest or backrest support, namely the seat - back - axis. In order to enable the movement relationship and above all to optimize the kinematic design relative to axes lying with like coordinates, is it advantageous that on the elongate coupling lever the middle pivot opening is provided slightly above the connecting line of the two outer-lying pivot openings. Thereby the seat connection in the rear region can lie relatively high which is favorable for the adjustment and coupling movement while the two other axes lie somewhat lower in the mechanism.

For the creation of other movement and adjustment possibilities, it is advantageous in another embodiment to provide a coupling level as an angle lever with three pivot openings forming an approximately right angle triangle. These two levers can then be selectively substituted for one another and thus make possible a plurality of different chair mechanisms. Also, other variations of the coupling lever are possible.

The coupling levers can basically be made in many shapes. As a support basis as wide as possible is necessary on account of the wide extent and the support of large forces, also with angle loading of the seat, such chair mechanisms as a rule are made symmetrical about a central longitudinal plane. Thus basically, pairs of elements and also pairs of coupling levers are provided which however in this description, on account of the only schematic description of the kinematic design, are referred to as a lever. However, it is especially advantageous that the coupling levers are formed as a component somewhat U-shaped in profile with two flanks having the pivot openings. They are then automatically supported tilt-free and offer a wide base for the support of the forces and for the support of inserted axes on which the adjustment elements or the like can engage. In like manner, the support part, seat part and backrest support respectively are formed with parallel flat walls as cast parts, forged parts or advantageously bent and/or welded-together sheet metal parts. However, this will not be dealt with especially in the description because such components for individual chair mechanisms are long known.

In an advantageous development of the invention, it can be provided that the backrest support in its forward upper region has a pivot opening which in the kinematic design, all with selectively substitutable pivot-multiangle-elements to form support and adjustment devices, always lies in the same position, namely in the position of the seat-back axes and over a pivot axis bar connects the backrest support, the coupling lever and the support part or a coupling provided between the support part and seat-back-axis.

The different movements can be enabled within the linkage-multiangle with a corresponding number of levers, corresponding lever lengths, and corresponding position of the linkage points. Here, mechanisms must be made relatively flat. Therefore it is especially favorable to provide in suitable positions sliding pivots, for example in the form of elongate openings in which plastic formed pieces are inserted in which suitable round axis bars can slide. For optimization of the kinematic design for different linkage-multiangles, it is useful when a sliding pivot is provided in a position lying in the middle region. Through insertion of corresponding lever and movement possibilities, one can favorably pick up the often only limited length alterations which are produced by the inclination movement and work constantly with relatively flat-lying levers. Accordingly, there can be provided on the support part forwardly of the common pivot axis- seat-back-axis a sliding pivot in which the pivot axis bar extending through the forward pivot axis of the coupling lever extends. Also, for such cases in which no length-wise sliding is required, a support for an axis bar can here be provided.

To enable the desired movement and coupling, there is provided to the desired chair mechanics, a variable length coupling. This permits favorable force support and force transmission adjustment and the like and is in many chairs known as a so-called adjustable gas spring, thus piston-cylinder-unit with gas filled chamber, if necessary with inserted helical spring, hydraulic circulating fluid valves and the like. It is used in many places in such chair mechanisms. In a further development, it can be provided that between the support part and an axis—coupling axis—lying in the same position in the whole kinematic design which selectively is pivotally coupled with the backrest support or simultaneously with the bakcrest support and the lower pivot point of the coupling lever formed as an angle lever, there is provided a variable length coupling. This coupling is thus provided between the backrest and the support part, preferably the lower region, and here the angle lever can also engage when it appears advantageous to the respective desired kinematics. In a further development, the variable length coupling can have a spring.

It is then an elastic coupling which attains movement of the seat and backrest with simple means. Moreover, the variable length coupling can have an adjustment. Thus, the coupled movement or inclination adjustment can be secured in fixed position stepless or with fine steps. Thereby, as is per se known, the variable length coupling can be an adjustable gas spring. Such a construction element has favorable damping characteristics and above all, all elements for adjustment, damping and arresting in a commercially available construction part. However, in particular on account of the fatigue of the gas reservoir and the high cost of a reliable gas spring, one can provide a simple strong coil spring with damping or arresting adjustment.

Favorable conditions for the entire kinematic design and the development of the construction part result when the coupling axis lies in the forward lower region of the backrest support.

The seat can be provided fixed or articulated so that it can carry out an inclination movement about an axis parallel to the forward edge of the seat or coupled movement with the backrest. For such a case, it is advantageous that between the support part and the seat-back-axis there is provided a variable length seat coupling which is formed as a seat support or is connected fast thereto. Then there is advantageously a forward pivot axis about which the seat with its coupling pivots. The rear pivot point can then be raised or lowered through suitable means. Thereby can the backrest here be pivoted therewith and raised therewith or in other manner be coupled for movement therewith. Thereby, it is advantageous when the forward pivot axis is positioned between the support part and the seat coupling far forward in the vicinity of the forward edge region of the seat. That is above all significant for such cases in which no great vertical movement by adjustment in the region of the thigh or in the knee region of the user is desired. However, if vertical movement is desired, the axis is positioned spaced from the forward edge region of the seat.

When movement and adjustment possibilities of the seat is not desired, for example for simpler work chairs, the support part and seat support are advantageously joined fast with one another or formed as a unitary construction part. Then however, parts of the entire kinematic design and therefore existing pivot openings and construction parts can still be used for a backrest adjustment without requiring special construction parts, special machining, or special tools.

An advantageous development concept for the adjustment of inclination or initial inclination between seat and backrest and support part can appropriately be provided such that between the rear pivot opening of the elongate coupling lever and a support member - support plate-lying at a distance from the seat-back-axis and mounted on the backrest support there is provided a variable length adjustment member which serves for inclination adjsutment of the backrest and/or seat support. By this construction, there is obtained an adjustability with simple means in a favorable position in the lower region of the backrest support. The entire kinematic design including a variable length coupling between the backrest support and the support part provides convenient adjustment of the inclination of the backrest and the seat. Thereby the adjustment element can advantageously be a screw provided with a hand wheel which engages in a pivot axis bar having a screw thread which is pivotally supported in the rear pivot opening of the elongate coupling lever. Such a per se known design is simple and dependable in operation; it is here however especially well incorporated in the entire kinematic design because the screw movement works on an axis which is well interchangeable on a corresponding pivot position. The counter support can there likewise be a through-bored pivot axis bar with corresponding pivoting in the back support or a flat wall with elongate opening and correpsonding sliding support of the spindle. Further developments, details, advantages and characteristics of the invention will appear also from the following description with reference to the drawings.

Exemplary embodiment of the invention will be explained and described in more detail below with reference to the drawings.

Figure 2:
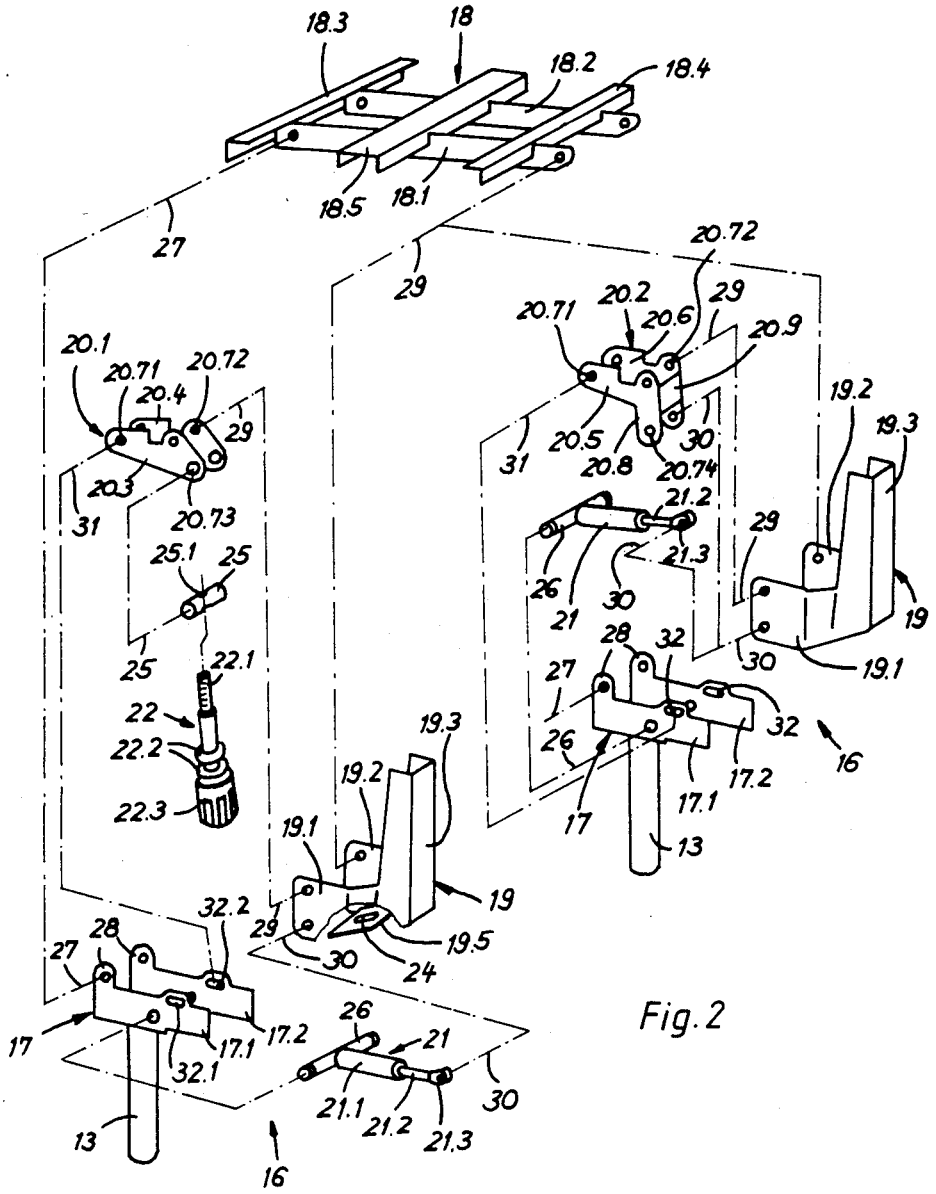
Figure 3:
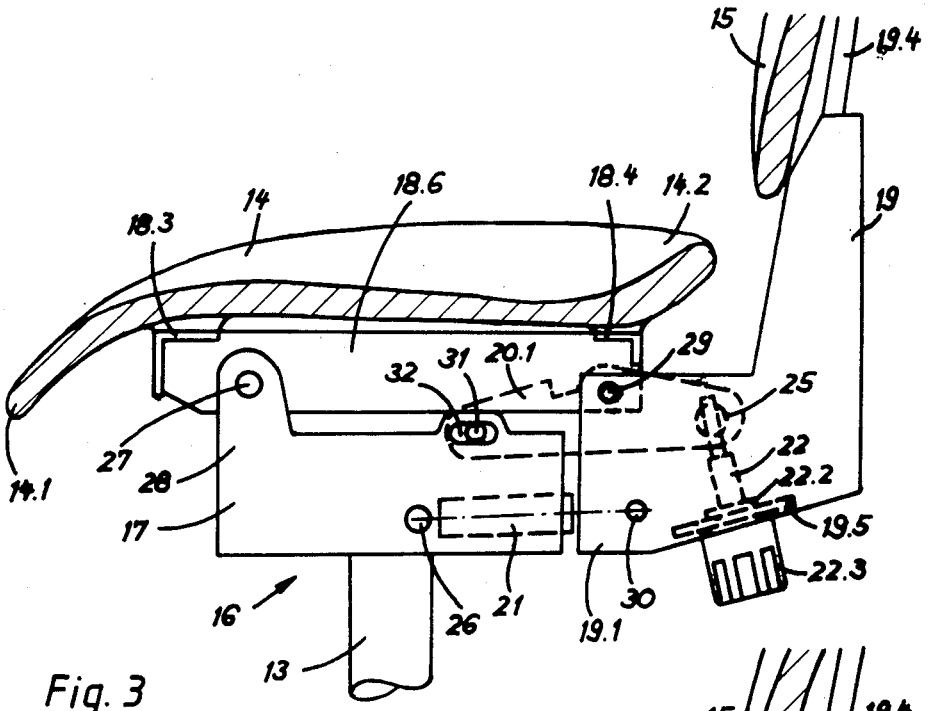

They are:

FIG. 1 A representation of a work chair with support and adjustment mechanism for seat and backrest;

FIG. 2 An exploded representation of a support and adjustment mechanism for seat and backrest with two variant designs for the coupling lever with representation of the common axes and elements;

FIG. 3 A schematic side view of seat and adjustment mechanism as well as part of the backrest of a first design example with elongate coupling lever.

Figure 4:
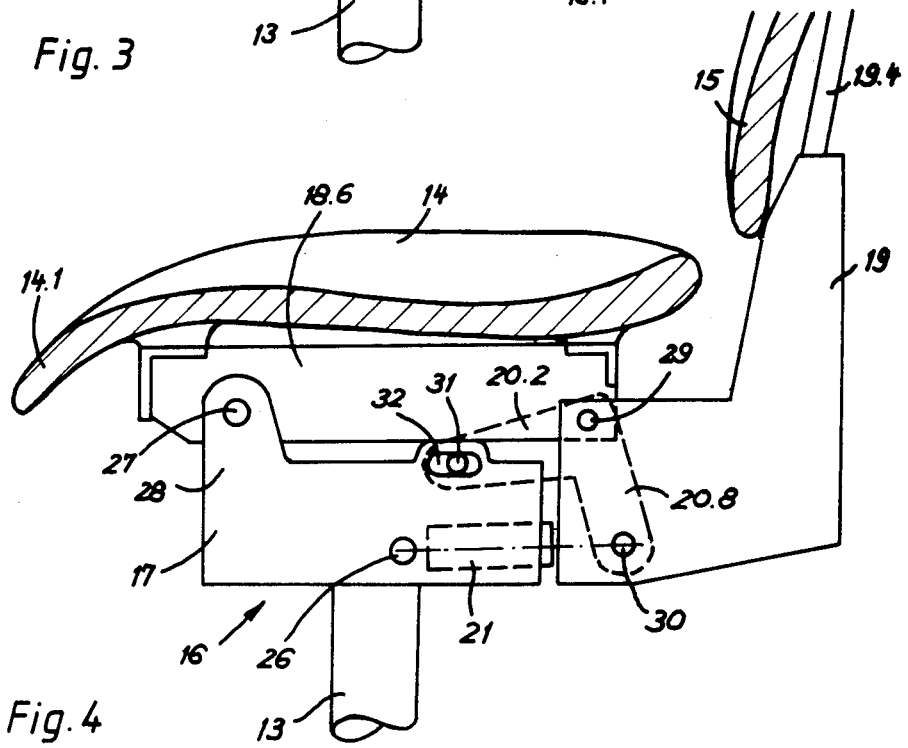

FIG. 4 A representation corresponding to FIG. 3 with a coupling lever in angle lever form.

Figure 5:
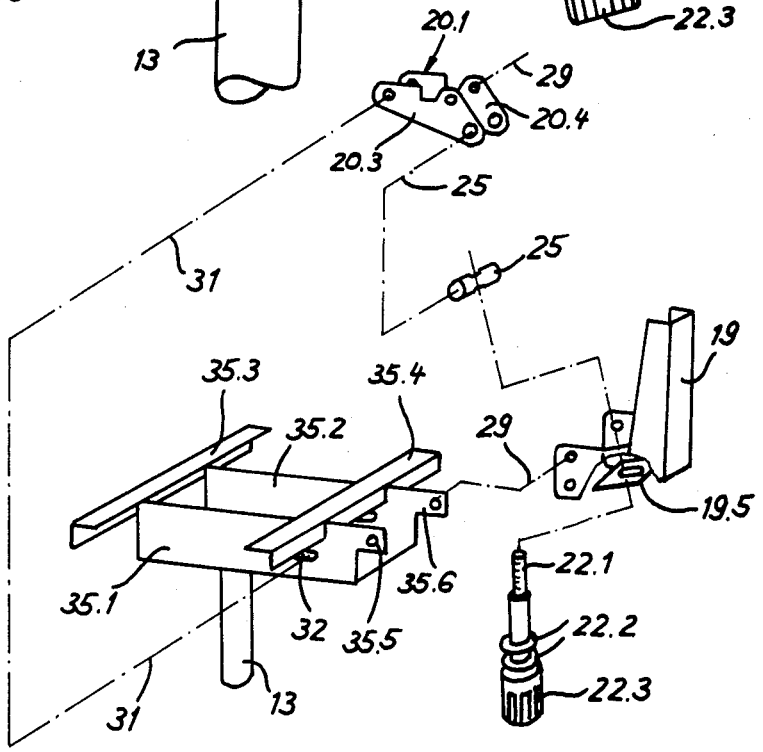

FIG. 5 An exploded representation of adjustment mechanism with similar parts of the kinematic designs, however for fast mounted seat and only with backrest adjustment.

Figure 6:
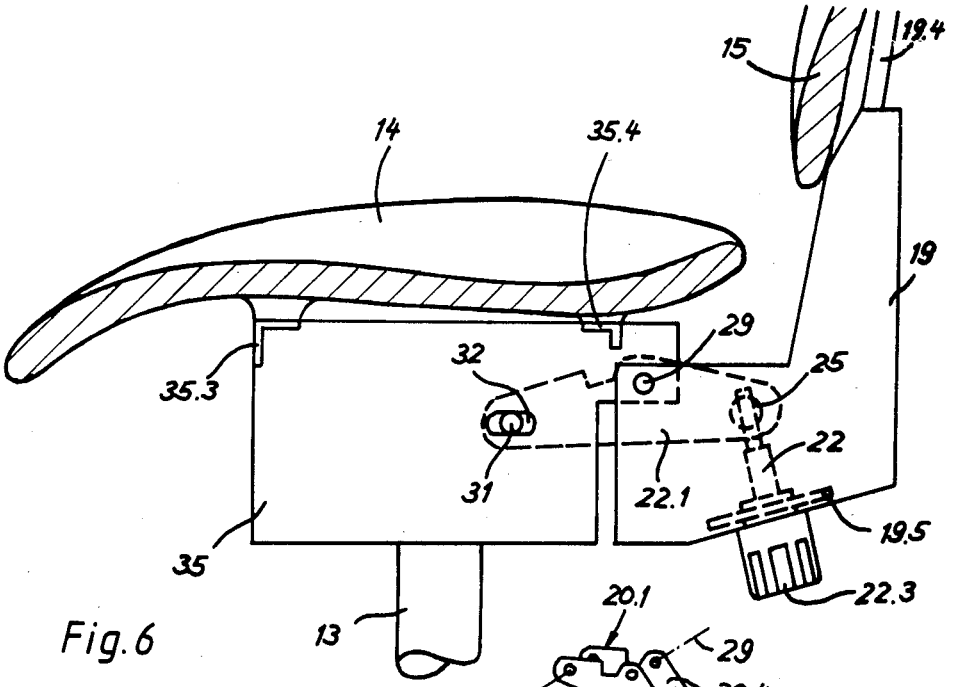

FIG. 6 Representation corresponding to the representation of FIGS. 3 and 4 with the adjustment mechanism of FIG. 5 by use of like construction parts only for the backrest adjustment.

A work chair 10 has a five arm pedestal 11 with rollers 12 and a preferable height-adjustable column 13, a seat 14 and a backrest 15 as well as a support and adjustment mechanism 16 for seat and backrest which also, as is a common practice, is designated as "chair mechanism".

The support and adjustment mechanism 16 has a support part 17 fast with the column 13, a seat support 18 and a backrest support 19 as well as a coupling lever 20.1 or in another design 20.2. Further, a length adjustment coupling 21 and an adjustment spindle 22 can be provided as is in part the case for the example of FIGS. 2 to 4.

Support part 17, seat support 18 and backrest support 19 have symmetrically on both sides of the longitudinal central plane 23 of the work chair vertically extending, at least partially overlapping, support and connecting flanges provided with pivot openings. These are connected with one another, if necessary through coupling members, by means of pivot axis bars. That is seen from FIGS. 2 to 4 and will now be explained.

The support part flanges 17.1 and 17.2 are seen from FIG. 2. They are connected through a not illustrated cross connection with the column 13. It is advantageously a stamped out and bent thick wall sheet metal part, if necessary welded, with connected means, having for example a thickness of 3 mm whereby the support flanges 17.1 and 17.2 lie about 100 mm apart.

The seat support 18 has seat support flanges 18.1 and 18.2 which likewise stand vertical and have a spacing somewhat more than 100 mm so that they lie outside the support part flanges 17.1 and 17.2. As seen from FIG. 2, they are connected with the help of seat support angles 18.3 and 18.4 and a U-shaped seat support bridge 18.5, for example through welding. As seen from FIGS. 3 and 4, the seat is laid on and fastened with suitable fastening means.

The backrest support 19 has backrest support flanges 19.1 and 19.2 which have a spacing somewhat less than 100 mm so that they lie inside the support part flanges 17.1, 17.2 and the seat support flanges 18.1 and 18.2. The exploded view of FIG. 2 shows how with the help of which axes the laid out parts are to be connected with one another.

The backrest support 19 has a connecting web 19.3 on which the backrest support bar 19.4 is mounted for a preferably height adjustable backrest 15. As seen from FIGS. 2 and 3, the backrest support 19 further has in a lower region a cross-wise extending support plate 19.5 which has an elongate opening 24. The elongate opening 24 can be penetrated by the adjustment spindle 22 which is supported on the support plate 19.5 with the help of support washers 22.2 on both sides.

The coupling levers 20 have coupling flanges 20.3 and 20.4 or 20.5 and 20.6 spaced about 35 mm from one another which are connected with one another by webs to yield a construction part U-shaped in profile which can be formed as stamped-out and bent parts of about 2 to 3 mm wall thickness but however can also be formed as cast or forged parts.

The two coupling levers 20.1 and 20.2 differ only through the profile of the coupling flanges. The coupling flanges 20.3 and 20.4 are formed as flat elongate levers with three pivot openings 20.71, 20.72 and 20.73. Thereby the middle pivot opening 20.72 lies somewhat above the connection of the pivot openings 20.71 and 20.73 lying in the region of the ends as seen from the left part of FIG. 2 and FIG. 3.

As seen from the right part of FIG. 2 and FIG. 4, the coupling flanges 20.5 and 20.6 are formed as angle levers with a arrangement of three pivot axes on a somewhat right angle triangle whereby the pivot openings 20.71 and 20.72 lie in the same positions while the pivot opening 20.74 is formed in a lower pivot lever part 20.8. Here the web region 20.9 is recognizable in the right part of FIG. 2.

For the articulation of the adjustment spindle 22 on the elongate coupling lever 20.2, there is provided an adjustment axle which is inserted in the rear pivot openings 20.73 of the elongate coupling lever and has a length which is a little greater than the width of the coupling lever 20.1. It has a threaded opening 25.1 in which the external thread 22.1 of the adjustment spindle 22 fits. The adjustment spindle 22 has a hand wheel 22.3 on its other end.

The varaiable length coupling 21 is a so-called gas spring. It comprises a piston-cylinder-unit of which the cylinder 21.1 is connected with a round bar, designated spring axis bar 26, in suitable manner, for example by screwing in a threaded opening. In the cylinder 21.1 plunges a piston rod 21.2 which has a piston rod head 21.3 with a pivot opening. In the inside, a piston is provided. There is a piston chamber filled with oil. There are provided valves, gas chamber and actuating means, in particular in the form of a pin inserted from the front so that the piston rod 21.2 can move in against spring force upon corresponding lessening of the adjustment and automatically moves out upon decreasing opposing force. Such a gas spring is widely used for chair mechanisms. It serves here to enable a soft displacement of the seat and backrest in coupled manner, actuatable against spring force. Thereto, it can be connected in two manners and is indeed either only on the backrest support 19 or simultaneously on the backrest support 19 and on the coupling lever 20.2 in angle-lever form as shown in FIG. 4.

Now that all individual elements of these embodiments have been explained, the kinematic design will be explained in more detail.

FIGS. 3 and 4 show that all pivot points in the kinematic design lie in the same position and indeed in the following manner: the seat forward axis 27 is positioned relatively far forwardly to the forward edge 14.1 of the seat so that this forward region does not rise or sink too strongly upon deviation. The support part flanges 17.1 and 17.2 have in this region an upstanding lug 28 on which the seat support 18 is articulated by a pivot axis—seat forward axis 27—not illustrated in detail. The seat support 18 is here as shown somewhat schematically as seat support coupling 18.6 simplified with respect to FIG. 2. In the region under the rear of the seat 14.2, the seat-back-axis 29 is formed in the seat support.

In the initial position, this lies approximately at the height of the seat-forward-axis 27. It is the common axis for the seat support 18 or seat support coupling 18.6, the backrest support 19 and the coupling 20 in the form of the elongate coupling lever 21.1 or the angle lever 20.2. In the embodiments shown by way of example in Figures 2 to 4, it is a seat-back-axis 29 movable in space which can swing up and down about the seat-forward-axis 27 on an arc corresponding to the length of the seat support coupling 18.6. This swinging is designated in further treatment as articulated-multi-angle. In order for the position of the seat-back-axis 29 to be a contributory determinant, the length adjusting coupling 21 is provided. This is in turn pivotally connected by means of the coupling axis 30 over the piston rod head 21.3 with the back carrier 19. Thereby the coupling axis 30 lies in approximately the height of the spacing corresponding to the mechanics almost directly under the seat-back-axis 29 but slightly displaced to the rear in the initial position of the kinematic design. It lies approximately in the forward lower corner region of the backrest support 19 and thus produces an essentially perpendicular pivot arm between the seat-back-axis 29 and the coupling axis 30. Somewhat parallel to the seat support coupling 18.6 lies the length adjusting coupling 21 so that its axis fast to the frame, designated as spring axis 26, lies in the region of the junction on the column 13 as illustrated in the figures. The spring axis 26 and the respective length of the length adjustment coupling 21 determine the kinematic possibilities of the movement of the seat-back-axis 29 and thereby of the seat and backrest which in this embodiment are coupled with one another. However, without a further support, the arrangement would sink down. Therefore the coupling lever 20 is provided for further support and regulation of the movement of the seat-back-axis 29. For the support of the forward sliding axis 31, there is formed in the support part 17 the sliding pivot 32 in the form of elongate openings 32.1 and 32.2 aligned with one another. There are for example, elongate opening plastic parts inserted, each of which has an opening corresponding to the thickness of the inserted pivot axis bar and lengthwise to the desired movement. This sliding pivot 32 is somewhat rearwardly offset relative to the middle so that there results a very flat-lying pivot arm on coupling lever 20 and indeed between the seat-back-axis 29 and the sliding axis 31. Moreover, as the coupling lever 20 is linked in suitable manner on the seat support 18, the length of the length-adjusting coupling 21 determines, by the part of the kinematic design considered up till now, the exact position of the seat-back-axis 29. If the length of the coupling 21 is reduced, the seat-back-axis 29 is lowered and the sliding axis 31 slides slightly forwardly in the sliding pivot 32. If the coupling 21 is elongated, the seat-back-axis 29 is raised and the sliding axis 31 shifts slightly rearwardly in the sliding pivot 32. There is thus a stable system with which the incination of the seat 14 can be determined through lengthening and shortening the coupling 21. Simultaneously, the backrest 15 moves according to the selected connection. If a constant like deviation of the backrest together with the seat without adjustable change of the relative position of the two to one another is desired, the angle-coupling-lever 20.2 according to the right side of FIG. 2 and FIG. 4 is selected. This is connected with its pivot opening 20.74 on the coupling axis 30. Thereby, the backrest is joined fast with the coupling lever 20.2 and follows all of its movements. The backrest then executes according to the evident lever movement, a small downward movement relative to the seat 14 which is determined through the lever length and the position of the pivot point, but cannot be adjusted. There is thus made possible the so-called dynamic seat in which there is provided a gas spring the setting of which can be adjusted. If the seat is unloaded, the backrest tilts forwardly and the seat rises at the rear. If the seat is loaded, the seat sinks according to the load, the kinematic relationship and the spring force and assumes a spring suspended condition. If the user leans on the backrest 15, the gas spring further contracts and thereby the variable length coupling 21 becomes shorter. The backrest inclines further towards the rear and the seat sinks further rearwardly. Through actuation of the adjustment of the gas spring, the desired position can be obtained in this manner.

The same movement can be obtained when additionally a relative adjustment between backrest and its linkage is desired. Then, the elongate coupling lever 20.1, as seen from FIG. 2 left and FIG. 3, is substituted for the angle lever 20.2. The spindle 22 then becomes rotatable, however not axially slidable, on the support plate 29.5 fastened on the backrest support 19 and is screwed in the adjustment axis 25 inserted through the pivot openings 20.73. Thereby the bearing of the spindle 22 lies spaced from the seat-back-axis 29 so that there results a linkage triangle with sliding pivot. Through varying the length of the spacing 25, 19.5, thus according to the screwed in condition of the spindle 22, the relative inclination of the backrest to the coupling lever 20.1 and thereby to the seat 14 and the seat support 18 is determined. Now there is a chair mechanism which on the one hand allows the seat inclination adjustment through lengthening or shortening the variable length coupling 21 and thereby alters the backrest inclination, that this however can through additional adjustment of spindle 22 again be adjusted for the respective desired relative position. As will be seen, different comfortable chair mechanisms can be realized through simple substitution and simple adjustment means which here, by way of example, a common and for the different cases optimized kinematic design suffices. More openings in the parts can naturally be provided according to other kinematic designs in which selectively pivot axis bars are insertable. The pivot axis bars can be simple round axis bars cut to length. As bearing elements are used bearing bushing parts, preferably provided with collars and holders advantageously of suitable low friction, durable plastic material. The pivot axis bars are held in their position by suitable means, spacing bushings and clamping rings, whereby the relative position also with respect to the orientation on the middle axis for all parts can easily be assured. Also on individual bars, tubes can be provided, in particular for the coupling lever, so that this can be held in its middle position.

The embodiment of FIGS. 5 and 6 uses axes, coupling levers and backrest support of the previous embodiment in order to realize a simpler chair mechanism.

Here the support part and the seat support are united in a single unitary construction part which is designated seat support 35 and has support flanges 35.1 and 35.2 on which the seat support 35.3 and 35.4 are fastened, for example welded. Thereon lies the seat 14. The connection on the column 13 is realized in usual manner through a cross wall or the like. Here the support flanges 35.1 and 35.2 have lugs 35.5 and 35.6 in which the seat-back-axis 29 is inserted in corresponding pivot openings.

The backrest support 19 is made as in the previous example and corresponds fully to the illustration in FIG. 2 left and FIG. 3. In the support flanges 35.1 and 35.2, the sliding pivot 32 is provided in the same position as in the other example. However, here it is used not as a sliding pivot but only as support.

The elongate coupling lever 20.1 is used in the previously described manner and is connected by the adjustment spindle 22 and the adjustment axis 25 as well as the support plate 19.5 with the backrest support 19. As will be seen, both of these construction parts and the position of the pivot points are selected the same so that the same construction parts can be produced in larger series and also can be used for simple chair mechanism. Here, the mechanism serves only for the inclination adjustable support of the backrest 15. The sliding axis 31 is here only a support axis which effects a fast unadjustable connection between the seat support 35 and the coupling lever 20.1. The backrest support 19 pivoted on the seat-back-axis 29 can swing about this seat-back-axis 29 when the handwheel 22.3 of the adjustment spindle 22 is rotated and this is screwed more or less into the adjustment axis 25. Thus a solid and nevertheless economical backrest adjustment for the inclination for a simple chair is realized with a construction part developed for other purposes but however inexpensive.

In summary, the invention can also be described as follows:

The support and adjustment mechanism has overlapping vertical flanges of a support part (17), a seat support (18) and a backrest support (19). According to a common optimized kinematic design, the pivot openings and the sliding pivot are located in predetermined positions so that selectively different elements can be united and different seat mechanics can be designed. Thereto, selectively usable coupling levers (20.1), (20.2) are provided. Also, further elements such as adjustable length coupling (21) can be installed.

What we claim is:

1. Support and adjusting mechanism for the seat and backrest of a work chair having a pedestal comprising feet and a support column supported by said feet, said mechanism comprising a support part fixed on an upper end of said support column, a seat support mounted on a forward part of said support part and a backrest support pivotally interconnected with a rear part of said seat support, said support part, seat support and backrest support having symmetrically, on opposite sides of a central longitudinal plane of said chair, vertically extending partially overlapping support and connection flanges having therein openings for reception of pivot members, a pair of coupling levers insertable between said support part, seat support and backrest support, each of said coupling levers having therein three pivot openings for reception of pivot members, said pivot openings in said coupling levers and said flanges including pivot openings and pivot members in said pivot openings for pivotally interconnecting forward ends of said coupling levers with said support part, pivotally interconnecting intermediate portions of said coupling levers with said seat support and backrest support and connecting rear ends of said coupling levers with said backrest support.

2. Support and adjusting mechanism according to claim 1, in which said coupling lever is an elongate lever with said three pivot openings of which two are near opposite ends of said lever and a third is intermediate said ends.

3. Support and adjusting mechanism according to claim 2, in which said third pivot opening is above a line connecting the pivot openings near opposite ends of said coupling lever.

4. Support and adjusting mechanism according to claim 1, in which said coupling lever is an angle lever with three pivot openings forming approximately a right triangle.

5. Support and adjusting mechanism according to claim 1, in which said coupling lever is generally U-shaped in profile with two parallel flat shanks having said pivot openings and a web portion connecting said flanks with one another.

6. Support and adjusting mechanism according to claim 1, in which said backrest support has in its forward upper region a pivot opening aligned with a pivot opening in a rear portion of said seat support and a pivot opening in an intermediate portion of said coupling lever, said backrest support, seat support and coupling lever being pivotally connected with one another by a pivot member in said aligned pivot openings.

7. Support and adjusting mechanism according to claim 1, in which said support part has in a rear portion thereof an elongate pivot opening and in which a pivot member in said elongate pivot opening of said support part and a pivot opening in a forward end portion of said coupling lever provides a sliding pivot between said coupling lever and said support part.

8. Support and adjusting mechanism according to claim 1, further comprising a variable length coupling pivotally connected between a lower portion of said support part and a lower forward portion of said backrest support.

9. Support and adjusting mechanism according to claim 8, in which said coupling lever is an angle lever with three pivot openings forming approximately a right triangle, said variable length coupling being pivotally connected simultaneously with said backrest support and a lower end of said coupling lever.

10. Support and adjusting mechanism according to claim 8, in which said variable length coupling comprises a spring.

11. Support and adjusting mechanism according to claim 8, in which said variable length coupling comprises means for effecting manual adjustment thereof.

12. Support and adjusting mechanism according to claim 8, in which said variable length coupling comprises an air spring.

13. Support and adjusting mechanism according to claim 1, in which an upper forward portion of said support part is pivotally connected with a forward part of said seat support and an upper forward portion of said backrest support is pivotally connected with a rear portion of said seat support.

14. Support and adjusting mechanism according to claim 13, in which the pivoted connection between said support part and said seat support is disposed far forwardly in the vicinity of a front edge of the seat.

15. Support and adjusting mechanism according to claim 1, in which said seat support is fixed with respect to said support part, forward ends of said coupling levers are connected with said support part with a sliding pivot and rear ends of said coupling levers are connected with said backrest support by a variable connecting member.

16. Support and adjusting mechanism according to claim 2, in which a variable length adjustment means acts between a rear end of said coupling lever and a fixed abutment on said backrest support.

17. Support and adjusting mechanism according to claim 16, in which said variable length adjustment means comprises a screw member screwed into a tapped hole in a pivot member in a rear pivot opening in said coupling lever and a hand wheel for rotating said screw member.

18. Support and adjusting mechanism for the seat and backrest of a work chair having a pedestal comprising feet and a support column supported by said feet, said mechanism comprising a support part fixed on an upper end of said support column, said support part having laterally spaced, parallel, upwardly extending support flanges, a seat support having laterally spaced, parallel downwardly extending flanges partially overlapping said flanges of said support part, means pivotally connecting said flanges of said seat support with said flanges of said support part in a forward region of said support part, a backrest support having laterally spaced, parallel, forwardly extending flanges partially overlapping said flanges of said seat support, means pivotally connecting said flanges of said backrest support with said flanges of said seat support in a rear region of said seat support, a coupling lever having laterally spaced, parallel vertical flanges partially overlapping said flanges of said support part, said seat support and said backrest support, means pivotally connecting a forward region of said flanges of said coupling lever with said flanges of said support part, means pivotally connecting intermediate regions of said flanges of said coupling lever with said flanges of said seat support and said backrest support, means pivotally connecting rear regions of said flanges of said coupling lever with said flanges of said backrest support and a variable length coupling between a lower region of said support part and lower regions of said backrest support.

19. Support and adjusting mechanism according to claim 18, in which said variable length coupling comprises an air spring.

20. Support and adjusting mechanism according to claim 18, in which said coupling lever is an elongate member.

21. Support and adjusting means according to claim 18, in which said coupling lever is an angular member.

22. Support and adjusting means according to claim 21, in which said means pivotally connecting said coupling lever with said backrest support comprises means for adjusting said pivotal connecting means relative to said backrest support.

* * * * *